US006629748B2

(12) United States Patent
Shimoyama

(10) Patent No.: US 6,629,748 B2
(45) Date of Patent: Oct. 7, 2003

(54) IMAGE FORMING APPARATUS AND IMAGE FORMING APPARATUS PUMP

(75) Inventor: Noboru Shimoyama, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 10/051,969

(22) Filed: Jan. 16, 2002

(65) Prior Publication Data

US 2002/0114717 A1 Aug. 22, 2002

Related U.S. Application Data

(63) Continuation of application No. 09/640,382, filed on Aug. 17, 2000, now abandoned.

(30) Foreign Application Priority Data

Aug. 20, 1999 (JP) ..... 11-234430

(51) Int. Cl.[7] ..... B41J 2/165
(52) U.S. Cl. ..... 347/30
(58) Field of Search ..... 347/30, 29, 32, 347/33, 23, 35; 417/399, 400

(56) References Cited

U.S. PATENT DOCUMENTS

| | | | | |
|---|---|---|---|---|
| 4,762,483 A | 8/1988 | Tieben | ..... | 417/399 |
| 6,270,323 B1 | 8/2001 | Hsu | ..... | 417/399 |

FOREIGN PATENT DOCUMENTS

| | | |
|---|---|---|
| JP | 7-89096 | 4/1995 |
| JP | 7-132617 | 5/1995 |
| JP | 7-205451 | 8/1995 |
| JP | 10-67121 | 3/1998 |

*Primary Examiner*—Shih-wen Hsieh
(74) *Attorney, Agent, or Firm*—Fitzpatrick, Cella, Harper & Scinto

(57) ABSTRACT

An image forming apparatus includes cap members for capping ejection outlets of an ejection portions for ejecting liquid to a recording material; pump diviec including suction inlets in fluid communication within the cap members; discharging outlets for discharging the liquid; cylinder member including a plurality of cylinders having the suction inlets and the discharging outlets, respectively; a seal member for dividing inner space in the cylinder divice into the cylinders; and a plurality of pistons reciprocable in the spaces in contact with the inner surfaces of the cylinders to produce pressure change in the inner spaces; wherein in each of the cylinders, the suction inlet is disposed more away from seal member than the discharging outlet.

13 Claims, 16 Drawing Sheets

(a) BLK (b) CHROMATIC (c) PHOTO

IMAGE FORMING APPARATUS AND IMAGE FORMING APPARATUS PUMP

This application is a continuation of application Ser. No. 09/640,382, filed Aug. 17, 2000, now abandoned.

FIELD OF THE INVENTION AND RELATED ART

The present invention relates to an image forming apparatus which forms an image on recording medium by ejecting liquid such as ink from a printing head, and a pump for such an image forming apparatus.

In an image forming apparatus such as an ink jet printer, ink is ejected from the ejection orifices of a printing head to form an image on a piece of recording medium. During the operation of such an image forming apparatus, ink (with increased viscosity), dust, and the like, adhere to the ejection orifices of the printing head. Thus, in order to remove these contaminants, an ink jet printer is generally provided with a recovery means to keep stable the ink ejection performance of the printer.

A recovery means generally comprises a capping means, a wiping means, and a pumping means. The capping means comprises a plurality of caps for covering the printing head, across the surface with ejection orifices, while the apparatus is not recording. It prevents ink from drying or evaporating while the apparatus is not recording. The wiping means comprises a blade or the like for removing the ink adhering to the printing head surface with ejection orifices. The pumping means suctions the ink with increased viscosity, and the like, from the ejection orifices and their adjacencies, through the capping means.

Generally speaking, a conventional pumping means comprises a cylinder and a piston which shuttles within the cylinder, with its peripheral surface remaining in contact with the internal surface of the cylinder. Technology regarding such a pumping means is disclosed in Japanese Laid-Open Patent Application No. 067,121/1998.

FIG. 18 is a schematic sectional drawing which presents an example of a conventional pumping means for an image forming apparatus. As depicted in FIG. 18, the pumping means comprises a cylinder 160, and a piston 164 which shuttles within the cylinder 160. The cylinder 160 is provided with two ink suction holes 161 and 162 and one ink discharge hole 163. The ink suction holes 161 and 162 are connected to two capping members (unillustrated), one for one.

When the pumping means structured as described above is in operation, the piston 164 shuttles within the internal space of the cylinder 160, with its peripheral surface remaining in contact with the internal surface of the cylinder 160. As the piston 164 shuttles, ink is suctioned into the cylinder 160 through the ink suction holes 161 and 162, and then is discharged from the cylinder 160 through the ink discharge hole 163 as a common ink discharge hole. This pumping means is superior in space utilization efficiency, compared to a pumping means which comprises two caps, and two cylinders parallelly disposed corresponding one for one to the two caps. In other words, this pumping means has an advantage over the latter, in that it makes it possible to reduce the overall size of an image forming apparatus.

However, the pumping means structured as described has a problem. That is, after the ink is suctioned into the cylinder, the ink is left alone to discharge itself out of the cylinder by its own weight. As a result, a certain amount of ink remains within the cylinder. If the ink which is remaining in the cylinder adheres to the internal surface of the cylinder and solidifies there, there is a possibility that the gap between the cylinder and piston fails to be properly sealed. If the gap fails to be properly sealed, air is allowed to leak through the gap, causing the pumping means to fail to properly suction ink. There is also a possibility that the ink will remain between the cylinder and piston and solidifies there. If the ink which is remaining between the cylinder and piston solidifies, the force required to make the piston slide on the internal surface of the cylinder sometimes becomes large enough to prevent the piston from being driven, which results in ink suction failure.

SUMMARY OF THE INVENTION

A principal object of the present invention is to provide an image forming apparatus pump which does not suffer from leakage and waste liquid solidification which lead to suction failure, and to provide an image forming apparatus equipped with such a pump.

Another object of the present invention is to provide an image forming apparatus pump capable of easily discharging waste liquid, and to provide an image forming apparatus equipped with such a pump.

According to an aspect of the present invention, there is provided an image forming apparatus comprising cap members for capping ejection outlets of an ejection portions for ejecting liquid to a recording material; pump means including suction inlets in fluid communication within said cap members; discharging outlets for discharging the liquid; cylinder means including a plurality of cylinders having said suction inlets and said discharging outlets, respectively; a seal member for dividing inner space in the cylinder means into said cylinders; and a plurality of pistons reciprocable in the spaces in contact with the inner surfaces of the cylinders to produce pressure change in the inner spaces; wherein in each of said cylinders, said suction inlet is disposed more away from seal member than said discharging outlet.

According to another aspect of the present invention, there is provided a pump for an image forming apparatus which includes cap members for capping ejection outlets of an ejection portions for ejecting liquid to a recording material, said pump comprising suction inlets in fluid communication within said cap members; discharging outlets for discharging the liquid; cylinder means including a plurality of cylinders having said suction inlets and said discharging outlets, respectively; a seal member for dividing inner space in the cylinder means into said cylinders; and a plurality of pistons reciprocable in the spaces in contact with the inner surfaces of the cylinders to produce pressure change in the inner spaces; wherein in each of said cylinders, said suction inlet is disposed more away from seal member than said discharging outlet.

As described above, according to the present invention, an image forming apparatus pump comprises a plurality of cylindrical portions which are provided with the suction hole or holes and discharge hole or holes, and are aligned in a straight line; a single or plural sealing members which serve as a divider between the internal spaces of the adjacent two cylinder portions, and a plurality of pistons which shuttle within the correspondent cylinder portions, with the peripheral surface thereof remaining in contact with the internal surfaces of the cylinder portions, to change the internal pressures of the cylinder portions. After being suctioned into the internal spaces of the plurality of cylinder portions, liquid is almost completely discharged through the discharge holes by the pressure generated in the space between the pistons and correspondent sealing members. In other words, according to the present invention, it is possible to prevent leakage and solidification of waste liquid, which lead to suction failure, by reducing the amount of the liquid which remains in the cylinder.

Further, the present invention eliminates the need for arranging a plurality of the cylinder portions in parallel corresponding to a plurality of capping member, making it possible to reduce the overall size and cost of an image forming apparatus.

Further, according to the present invention, in each cylinder portion, the suction hole is disposed on the far side, with respect to the discharge hole, from the sealing member, making it possible to place the discharge holes closer to each other to make it easier to dispose waste liquid.

Further, according to the present invention, a plurality of rings are on the peripheral surface of each of the plurality of pistons so that only the peripheral surfaces of the rings make contact with the internal surface of each cylinder portion, reducing the size of the contact area between the internal surface of the cylinder and the peripheral surface of the piston. Therefore, even if liquid enters between the internal surface of a cylinder portion and a piston, and solidifies there, it does not occur that liquid fails to be satisfactorily suctioned due to the insufficiency in the piston driving force.

Further, according to the present invention, among the plurality of the rings on the peripheral surface of each of the plurality of pistons, the ring on the upstream side in terms of the direction in which the piston moves for suctioning is rendered greater in external diameter than the ring on the downstream side, equalizing both rings in their contact pressure upon the internal surface of the cylinder portion to prevent leakage. Therefore, liquid is reliably suctioned.

In addition, the force required to drive the pistons is smaller, making it possible to employ a motor, or the like, with relatively low torque as a driving force source to reduce noise level compared to when a high torque motor is employed.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings.

Figure 1:
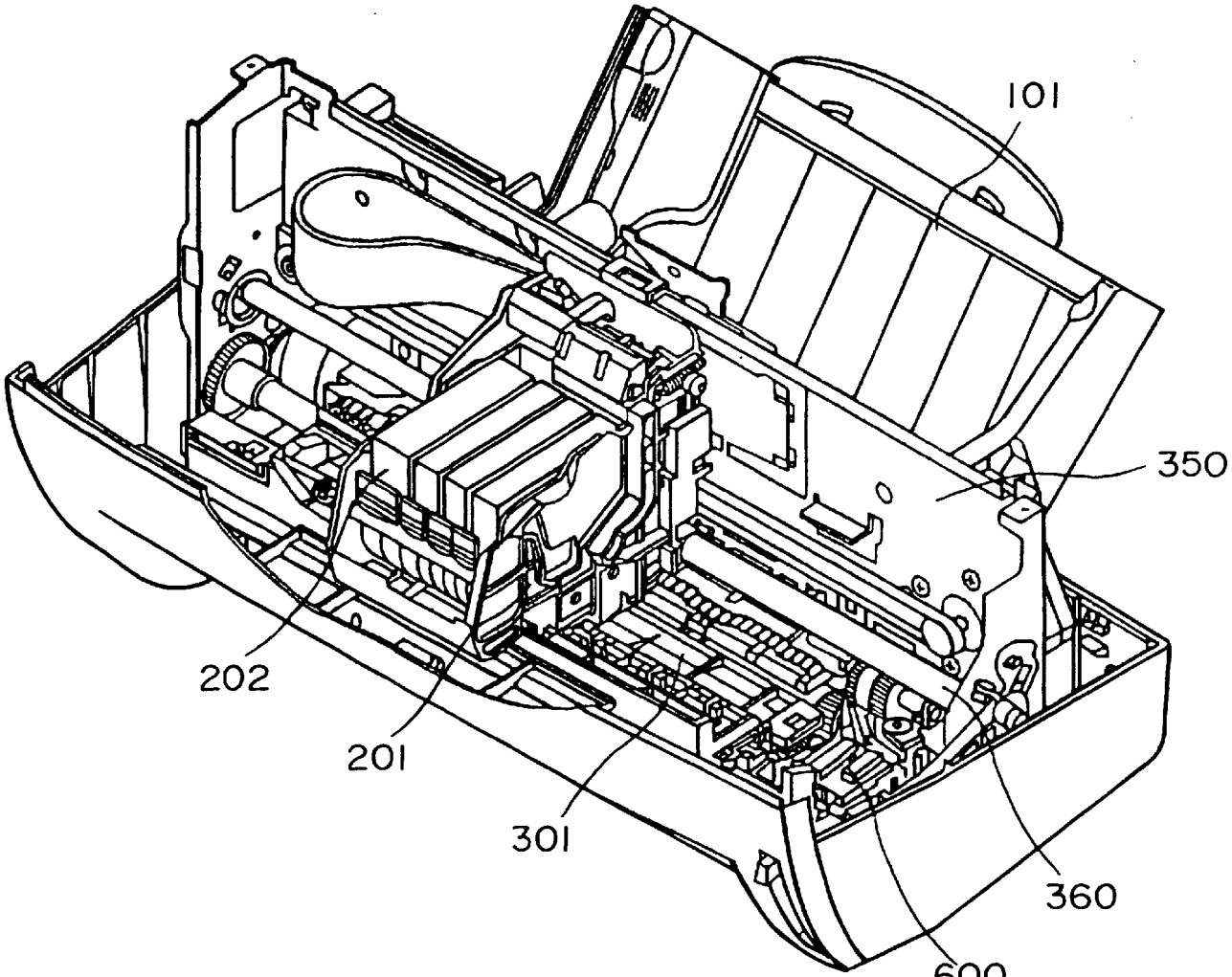
FIG. 1 is an external perspective view of the image forming apparatus in an embodiment of the present invention.
Figure 2:
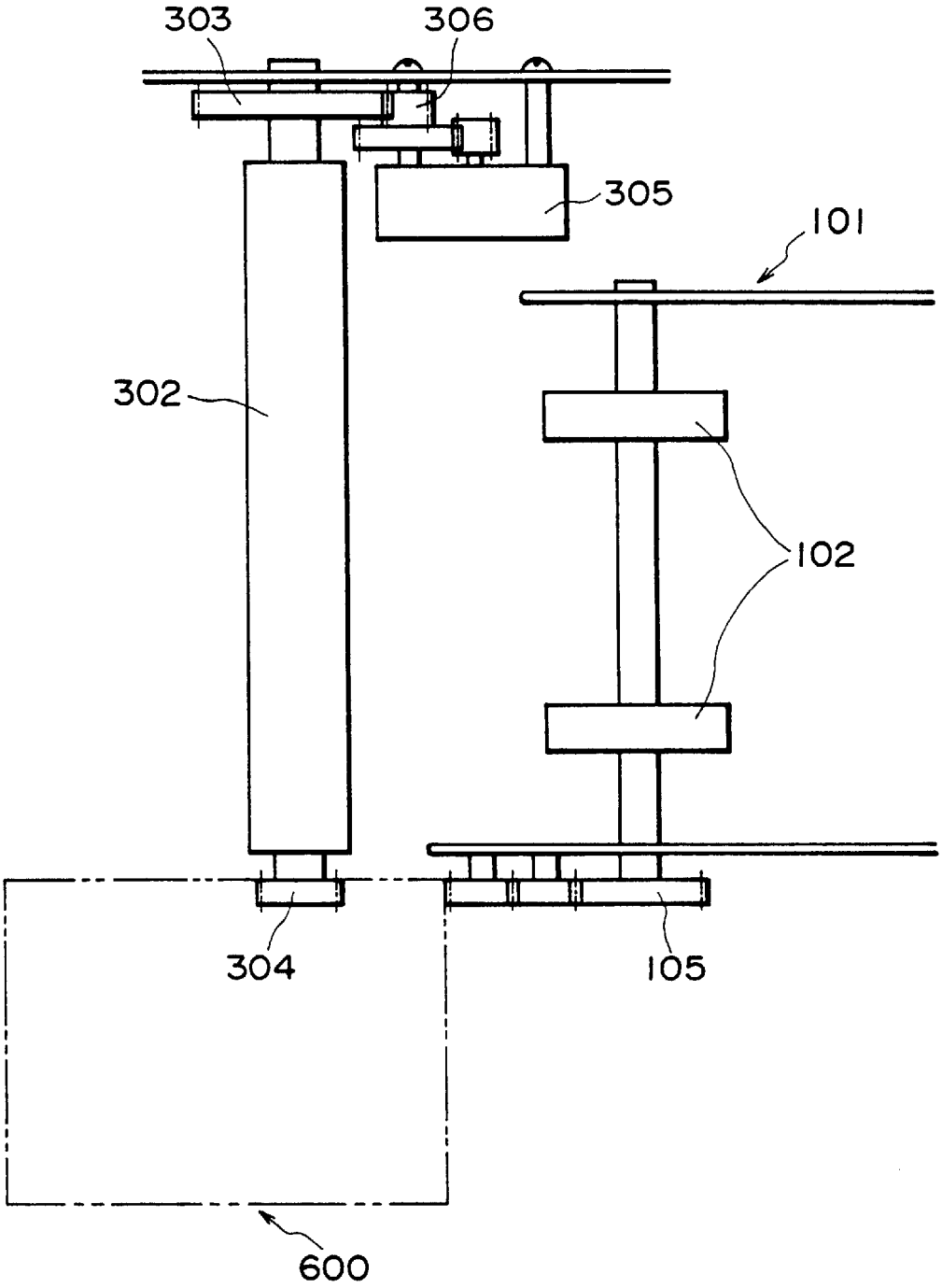
FIG. 2 is a schematic plan view of the sheet conveyance mechanism for conveying the sheets placed in the sheet feeder tray illustrated in FIG. 1, onto the platen illustrated in FIG. 1.

FIG. 1 is an external perspective view of the image forming apparatus in an embodiment of the present invention. FIG. 2 is a plan view of the sheet conveyance mechanism for conveying the sheets placed in the sheet feeder tray 101 illustrated in FIG. 1, onto the platen 301 illustrated in FIG. 1.

Figure 16:
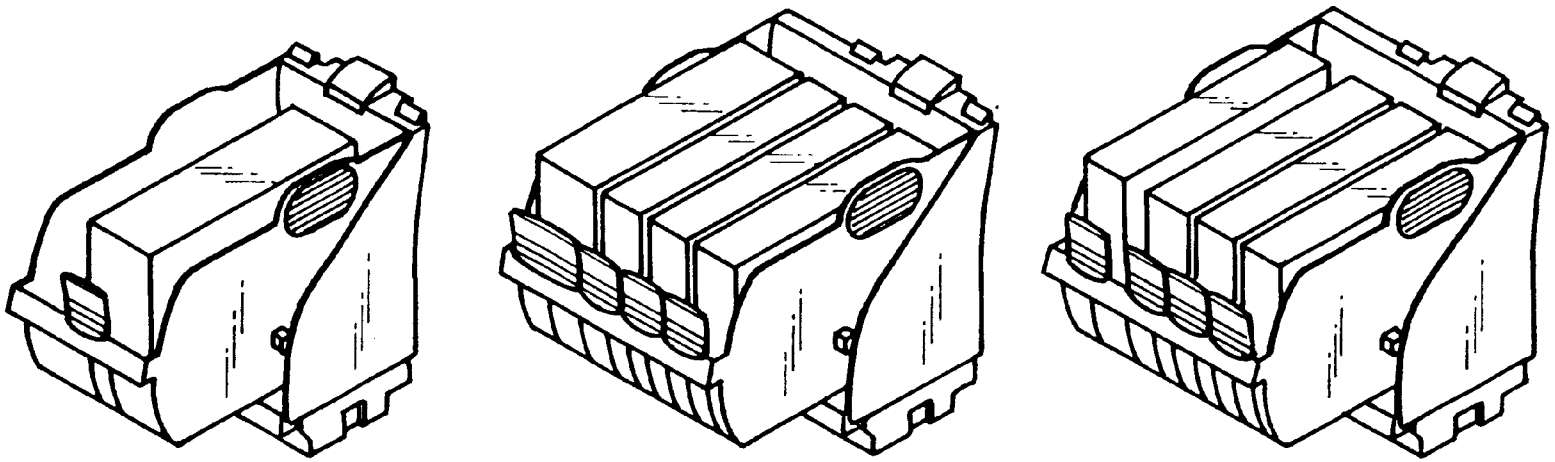
FIG. 16 is a perspective view of a head cartridge integrally comprising a printing head and an ink container; FIGS. (a), (b), and (c) correspond to a black cartridge, a color cartridge, and a photographic cartridge.

FIG. 16 is a perspective view of a head cartridge integrally comprising a printing head and an ink container. In FIG. 16, FIGS. (a), (b), and (c), correspond to a black cartridge, a collar cartridge, and a photographic cartridge. The number of ejection orifices is different for a black head, a color head, and a photographic head, and will be described later in detail. These printing heads are optionally mounted on a carriage 201; one of them is mounted according to the printing objective.

Figure 17:
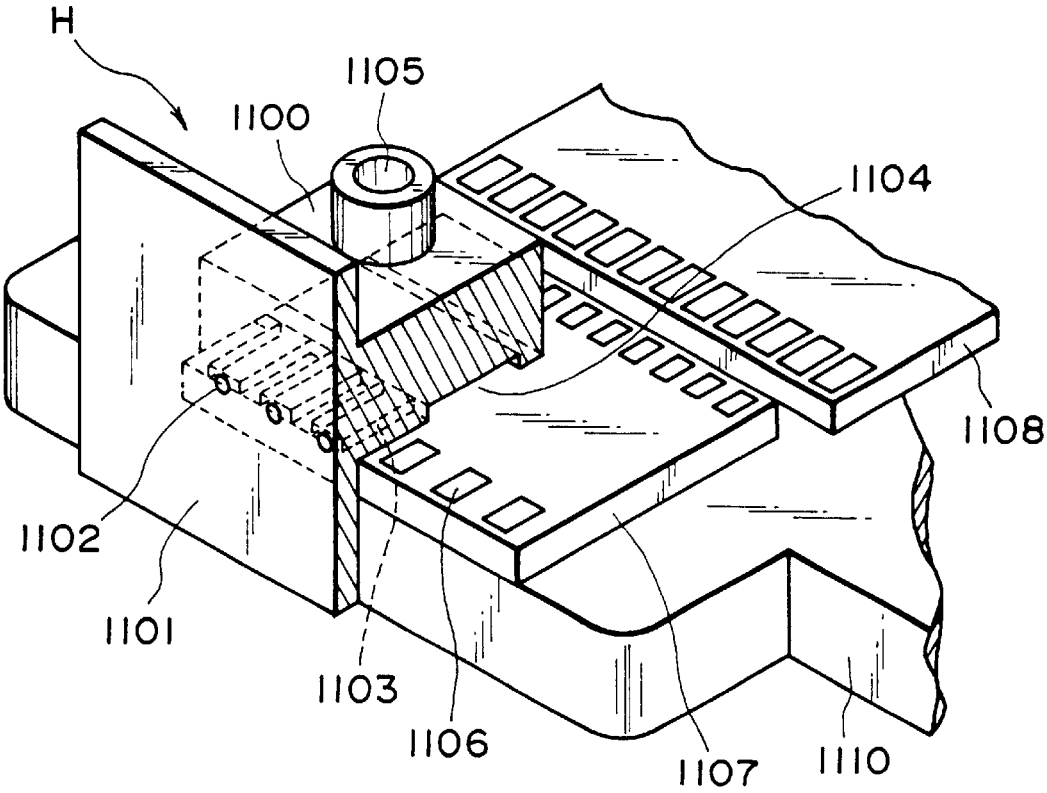
FIG. 17 is a perspective view of the essential portion of an ink jet recording head in accordance with the present invention, with some portions, omitted.
Figure 18:
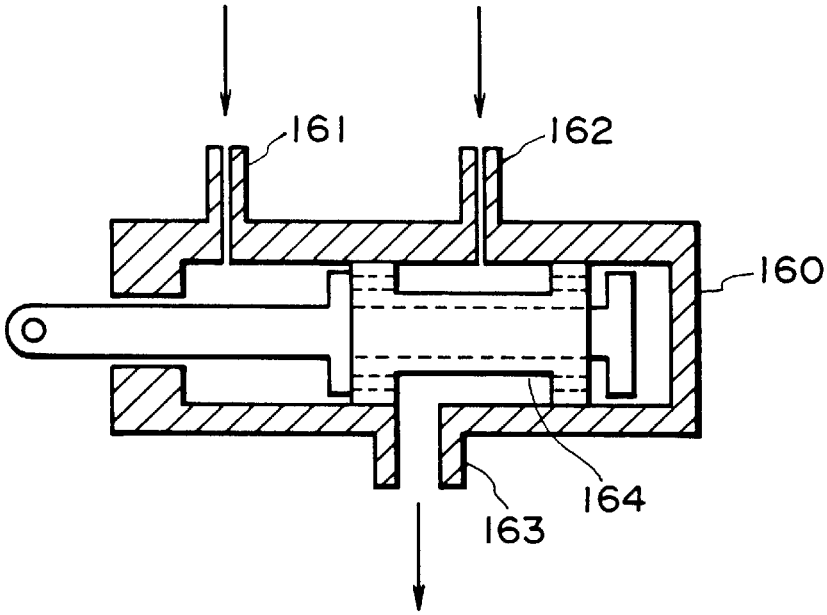
FIG. 18 is a schematic sectional view of an example of a conventional pumping means to be placed in an image forming apparatus, and depicts the structure of the pumping means.

FIG. 17 is a perspective view of the essential portion of one of the image forming apparatuses in accordance with the present invention, with some portions omitted. The top member of an ink jet recording head H (400) is made of resinous material, and integrally comprises: a top plate portion, in which a liquid chamber 1104 for storing recording liquid, and a plurality of liquid paths, are formed; an ejection outlet plate portion 1101, in which a plurality of ejection orifices 1102 correspondingly connected to the plurality of liquid paths 1103 are formed; and a recording liquid receiving portion 1105. A heater board 1107 comprises: a substrate formed of silicone; a plurality of heaters (electrothermal transducers) 1106, which are aligned on the silicone substrate to generate the thermal energy to be used for causing the so-called film boiling in the ink to eject ink; and unillustrated wiring for supplying these heaters with electrical power. These heaters and the wiring are formed by a known film formation technology. The heater board 1107 is fixed to a base plate 1110 by a known die bonding technology. The wiring substrate 1108 is provided with the wiring connected to the wiring of the heater board 1107 by a known wire bonding technology, and with a plurality of pads 1109 which are positioned one for one at both ends of the wiring to receive electrical signals from the main assembly of the image forming apparatus. The top plate 1100 and heater board 1107 are bonded to each other, with the plurality of the liquid paths 1103 and heaters 1106 aligned one for one to each other, and are fixed to the base plate 1110, along with the wiring substrate 1108, forming the ink jet recording head H.

Referring to FIGS. 1 and 2, the image forming apparatus in this embodiment comprises: a sheet feeder roller 102 for conveying the sheets (medium on which recording is made) placed in a sheet feeder tray 101; a conveyer roller 302 for conveying the sheets onto the platen 301 after the sheets are fed into the apparatus by the sheet feeder roller 102; a carriage 201 on which a printing head comprising a portion from which ink is ejected, and an ink container 203, are mounted; a rail 360 on which the carriage 201 is slidably supported to be shuttled in the longitudinal direction of the rail 360; a recovery means for restoring the performance of the plurality of printing heads mounted on the carriage 20; a driving mode switching means 600 driven by the conveyer roller 302; and a chassis 350.

In an image forming apparatus structured as described above, as the sheets placed in the sheet feeder tray 101 are conveyed onto the platen 301 by the sheet feeder roller 102 and conveyer roller 302, ink is ejected onto the sheets from the plurality of printing heads on the carriage 201 which are being shuttled on the rail 360. As a result, an image is formed on the sheets.

Next, the sheet feeder mechanism, illustrated in FIG. 1, for conveying the sheets from the sheet feeder tray 101 onto the platen 301 will be described.

The rotational force from a pulse motor 305 is transmitted by way of a speed reduction gear 306 to a conveyer gear 303 fixed to one of the longitudinal ends of the conveyer roller 302, in order to rotate the conveyer roller 302.

On the other hand, an LF output gear 304 is fixed to the other end of the conveyer roller 302. Therefore, the rotational force transmitted to the conveyer roller 303 is transmitted to the recovery means and sheet feeder gear 105 disposed within a switching means 600, by way of the LF output gear 30.

As the driving force is transmitted to the sheet feeder gear 105, the sheet feeder roller 102 rotates, and the sheets placed in the sheet feeder tray 101 are conveyed to the conveyer roller 302 by the rotation of the sheet feeder roller 102. After being conveyed to the conveyer roller 302, the sheets are conveyed onto the platen 301 by the conveyer roller 302.

Next, the driving mode switching means 600 illustrated in FIG. 1 will be described in detail.

Figure 3:
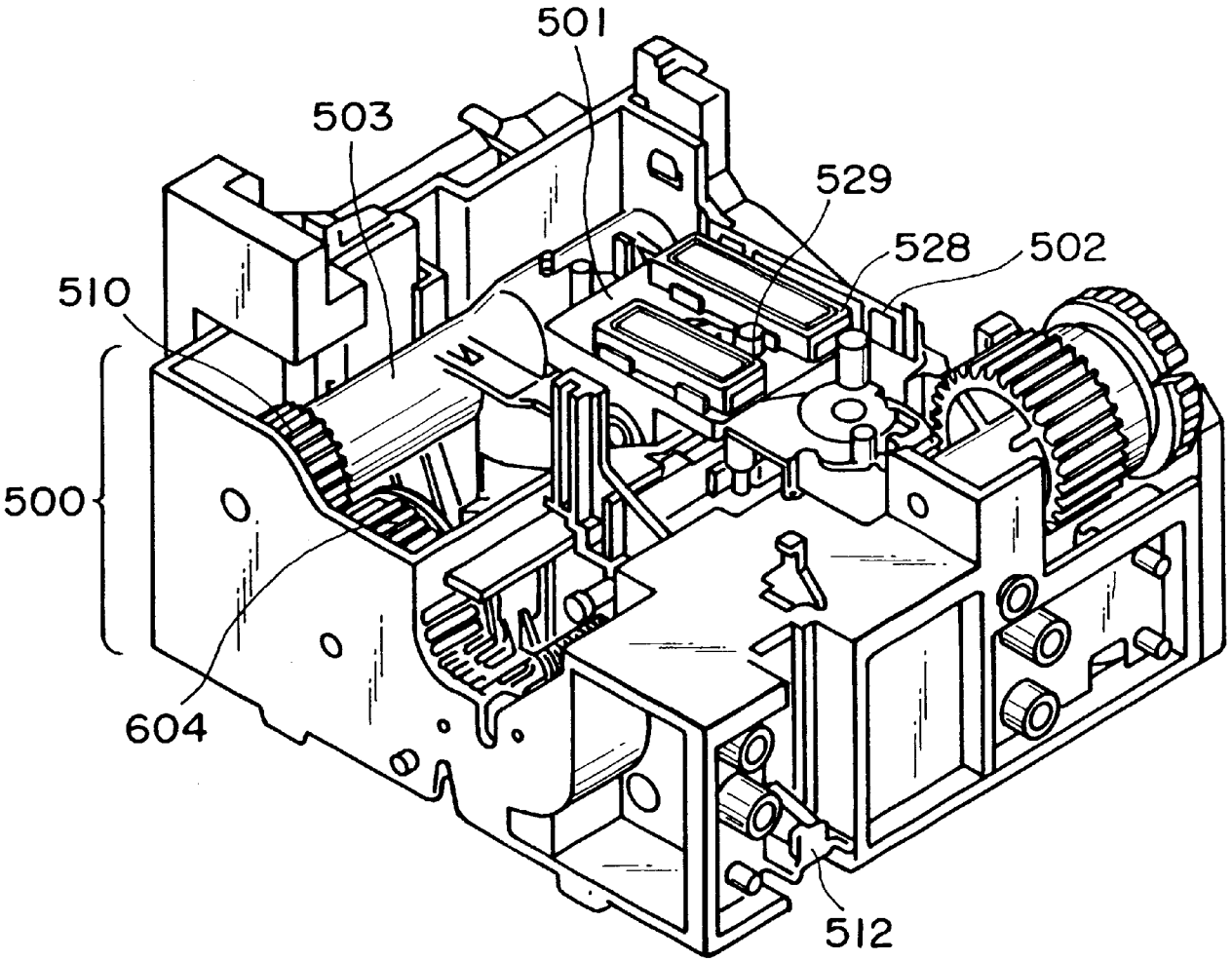
FIG. 3 is an external perspective view of the driving mode switching means illustrated in FIG. 1, and depicts the structure of the driving mode switching means.
Figure 4:
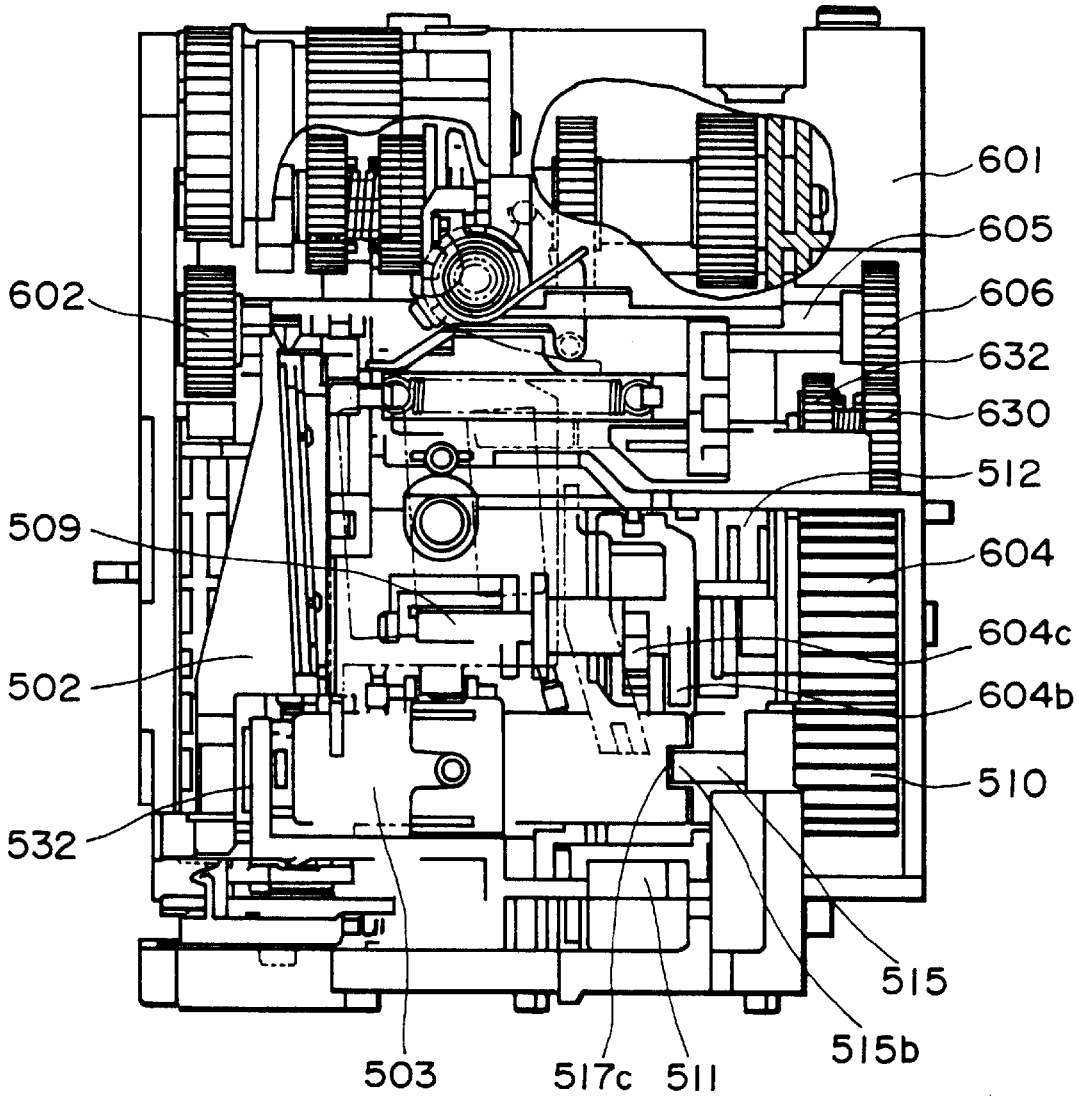
FIG. 4 is a plan view of the driving mode switching means illustrated in FIG. 3.

FIG. 3 is an external perspective view of the driving mode switching means 600 illustrated in FIG. 1, and depicts the structure of the driving mode switching means 600. FIG. 4 is a plan view of the driving mode switching means 600 illustrated in FIG. 3, and FIG. 5 is a plan view of the right side of the driving mode switching means 600 illustrated in FIG. 3.

Figure 5:
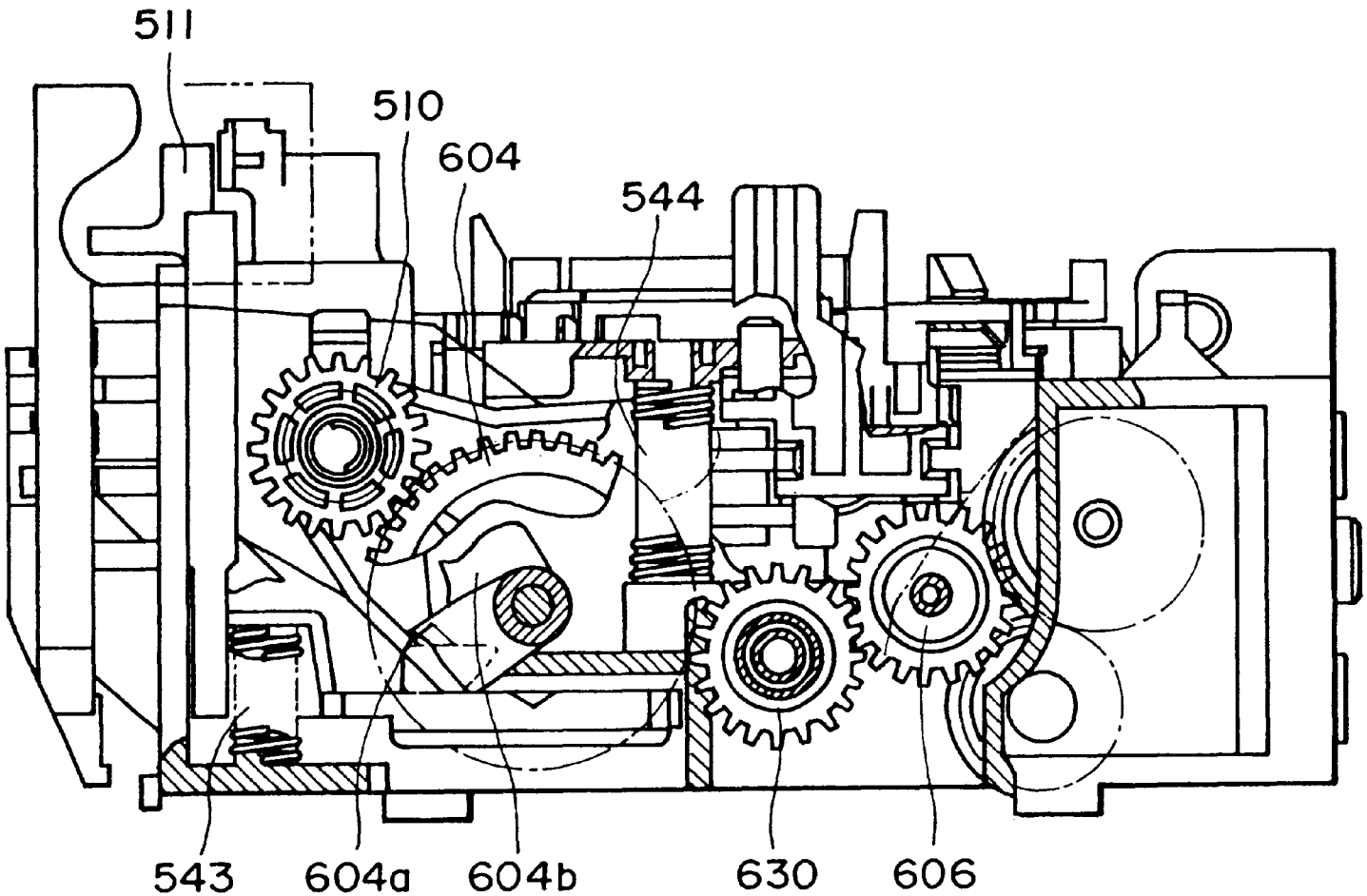
FIG. 5 is a plan view of the right side of the driving mode switching means illustrated in FIG. 3.

As shown in FIGS. 3–5, in order to prevent the drying or evaporation of ink, the printing head in this embodiment is provided with a capping means comprising caps 528 and 529 for capping the printing head surface which has the ejection orifices. The caps 528 and 529 are selectively activated depending on the configuration of the printing head surface which has ejection orifices. Further, the image forming apparatus in this embodiment is provided with a recovery means 500, which comprises a pumping means 503 and a wiping means 502. The pumping means 503 suctions ink, and the like, from the ejection orifices and the adjacencies thereof. The wiping means 502 removes the ink adhering to the printing head surface with ejection orifices, using of a blade (unillustrated). The capping means 501 and pumping means 503 are driven as the driving force is transmitted to the P output gear 604 and piston gear 510 from the LF output gear 304 (FIG. 2).

The P output gear 604 is a gear rotationally fitted around a P output gear shaft 509, the longitudinal ends of which are supported by a driving mode switching means base 601.

Further, the P output gear 604 comprises: a cam portion 604*b* for regulating the vertical movement of a carriage lock 511 which is under the pressure generated in the direction of the carriage 201 (FIG. 1) by a pressure generating means 543 such as a spring, and also, for regulating the phase of the toothless portion of the P outlet gear 604; a cam portion 604*c* for regulating the vertical movement of the caps 528 and 529; and a cam portion (unillustrated) for regulating a P sensor transmission lever 512 which engages with a P sensor lever (unillustrated), which detects the rotational angle of the cam 604*c*.

Next, the sequential steps through which the driving force from the LF output gear 304 (FIG. 2) is transmitted to the P output gear 604 and piston gear 510 will be described.

After being transmitted to an LF transmission gear 602 meshed with the LF output gear 304, the driving force is transmitted to a P clutch gear 630, by way of the LF transmission gear 602, a transmission shaft 605, and a P transmission gear 606.

When the pumping means 503 is driven, and immediately after the capping means 503 begins to be driven, a P clutch trigger gear 632 is slid by the carriage 201 (FIG. 1), whereby the latchet portion of the P clutch trigger gear 632 is meshed with the latchet portion of the P clutch gear 630.

Therefore, when the pumping means 503 is driven, and immediately after the capping means 503 begins to be driven, the driving force transmitted to the P transmission gear 606 is transmitted to the P output gear 604, and then is transmitted to the piston gear 510, rotating the piston gear 510.

The P output gear 604 is provided with a toothless portion, which is on the P clutch gear 630 side. Thus, when the pumping means 503 is not being driven, that is, when the sheets are being fed, when the sheets are discharged, when images are being printed, and when the like operations are carried out, the P output gear 604 is not in mesh with the P clutch gear 630.

Therefore, the driving force from the LF output gear 304 is transmitted to the P output gear 604, as the P output gear 604 is meshed with the P clutch gear 630 or P clutch trigger gear 632 when the pumping means 503 is driven, or immediately after the capping means 503 begins to be driven.

Next, the pumping means 503 illustrated in FIG. 3 will be described in detail.

Figure 6:
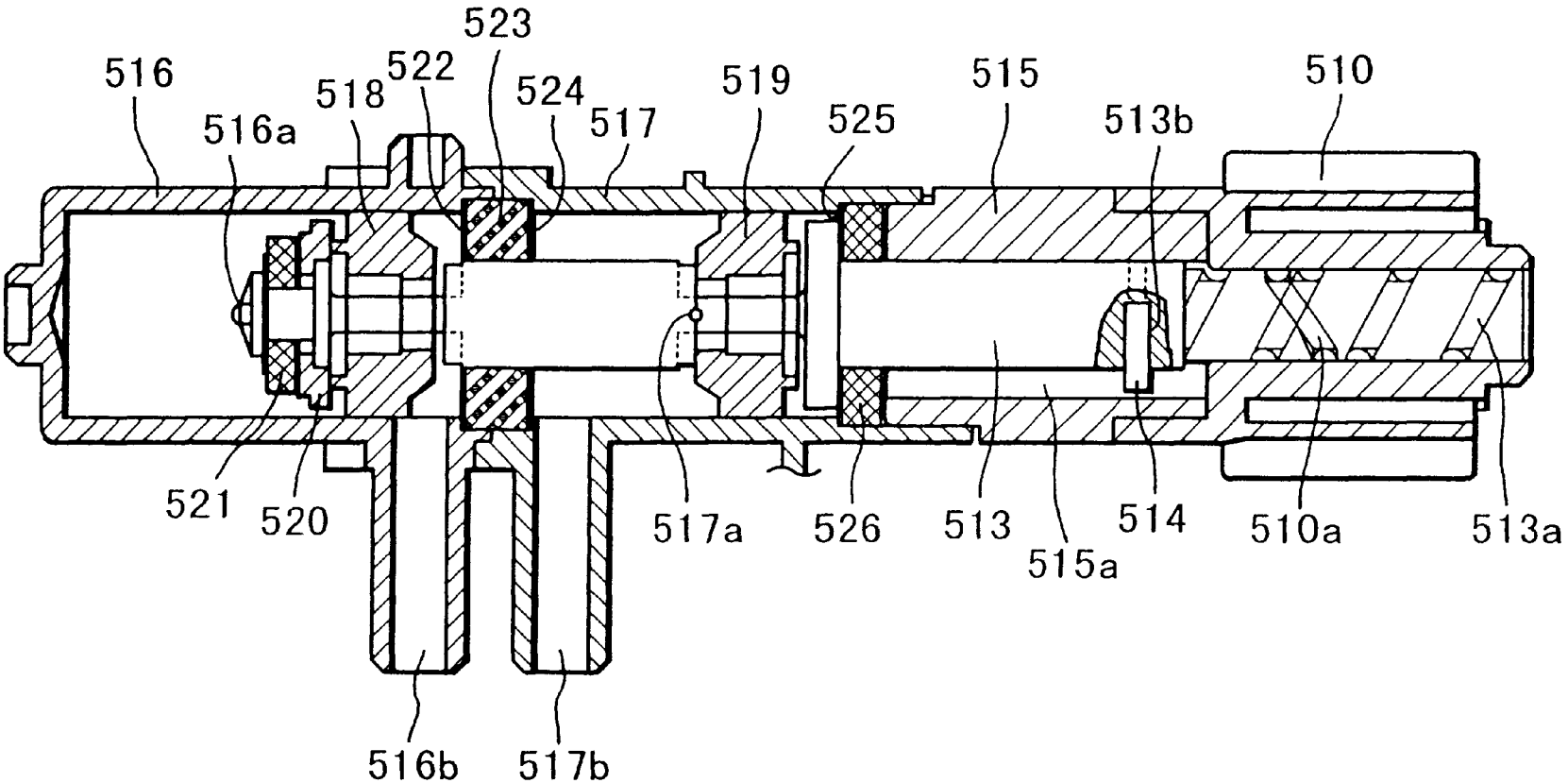
FIG. 6 is a sectional view of the pumping means illustrated in FIG. 3, and depicts the structure of the pumping means.

FIG. 6 is a sectional view of the pumping means 503 illustrated in FIG. 3, and depicts the structure of the pumping means 503.

As shown in FIG. 6, the pumping means 503 in this embodiment comprises: a cylinder portion 516 (which hereinafter may be simply called "cylinder") provided with an ink suction hole 516*a* and an ink discharge hole 516*b*; a cylinder portion 517 (which hereinafter may be simply called "cylinder") provided with an ink suction hole 517*a* and an ink discharge hole 517*b*; a sealing member 523 which is disposed between washers 522 and 524, being sandwiched by them, and serves as the divider between the cylinder portions 516 and 517; pistons 518 and 519 which shuttle within the cylinder portions 516 and 517, respectively; and a piston shaft 513 which supports the pistons 518 and 519.

In this embodiment, as the driving force from the piston gear 510 is transmitted to the piston shaft 513, the pistons 518 and 519 supported by the piston shaft 513 shuttle. As a result, ink is suctioned into the cylinder portions 516 and 517 through the ink suction holes 516*a* and 517*a*, and then is discharged through the discharge holes 516*b* and 517*b* by the pressure generated between the piston 518 and sealing member 523, and between the piston 519 and sealing member 523, respectively.

The surface of the center hole of the piston gear 510 has a guide portion 510*a*, so that the driving force from the piston gear 510 is transmitted to a screw portion 513*a* through the guide portion 510*a* in order to cause the piston shaft 513 to shuttle in the horizontal direction.

The piston shaft 513 is provided with a piston stopper 520 and a stopper rubber 521 for regulating the movement of the piston 518.

Between the cylinder portion 517 and cylinder cap 515, a sealing member 526 and a washer 525 are sandwiched.

The piston shaft 513 is provided with a guide pin 514, which has been pressed into a hole 513*b* with which the piston shaft 513 is provided. The guide pin 514 shuttles along a guide portion 515*a* with which the cylinder cap 515 is provided, preventing the piston shaft 513 from rotating.

Also, in order to prevent the piston shaft 513 from rotating, a projection (unillustrated) on the cylinder cap 515 is engaged in a recess (unillustrated) in the cylinder portion 517.

Next, the ink suctioning and discharging operations of the pumping means structured as described above will described in detail.

Figure 7:
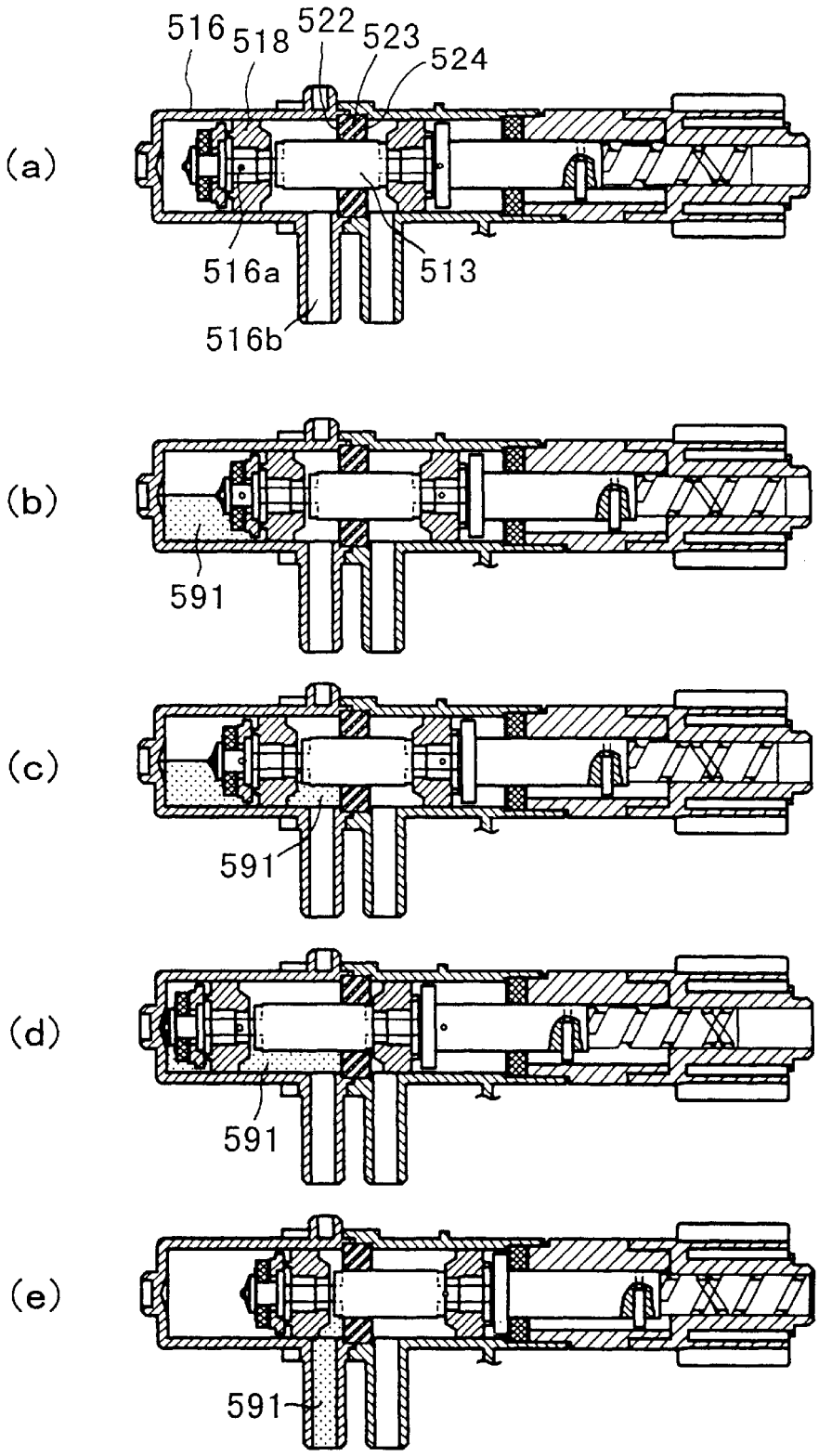
FIG. 7 is a drawing for describing the operational sequence through which ink is suctioned into, or discharged from, the cylinder 516 illustrated in FIG. 6.

FIG. 7 is a drawing for describing the processes through which ink is suctioned or discharged by the pumping means. At this time, the sequential steps will be described with reference to the cylinder portion 516.

As the piston 518 passes by the ink suction hole 516*a*, while moving from the initial position (FIG. 7, (*a*)) toward the ink discharge hole 516*b*, ink 591 is suctioned into the cylinder portion 516 by the accumulated negative pressure through the ink suction hole 516*a*. As the amount of the ink 591 reaches a predetermined value, the piston 518 stops there (FIG. 7(*b*)).

Next, the moving direction of the piston 518 reverses; the piston begins to move toward the initial position illustrated in FIG. 7, (*a*) (FIG. 7(*c*)). During this movement of the piston 518, the ink 591, which has been suctioned into the cylinder portion 516, moves toward the ink discharge hole 516*b* through the ink path provided between the piston 518 and piston shaft 513. The piston 518 moves to the end of its stroke (FIG. 7, (*d*)).

Next, the piston 518 begins to move toward the ink discharge hole 516*b*. As the piston 518 moves, the ink 591, which has moved toward the ink discharge hole 516*b*, is forcefully discharged through the ink discharge hole 516*b* by the pressure generated as the space between the sealing member 523 sandwiched by the washers 522 and 523, and piston 518 becomes less (FIG. 7, (*e*)).

Thereafter, the piston 518 shuttles a predetermined number of times (dry strokes). As the piston 518 goes through the dry strokes, the ink within the cylinder 516 is almost completely discharged through the ink discharge hole 516*b*.

The position from which the piston 518 begins to move, and the position of the other end of the piston stroke, may be varied depending on printing head type (in terms of color, capacity, and the like), so that the amount by which ink is suctioned into the cylinder portion is optimized, depending on the printing head type.

Figure 8:
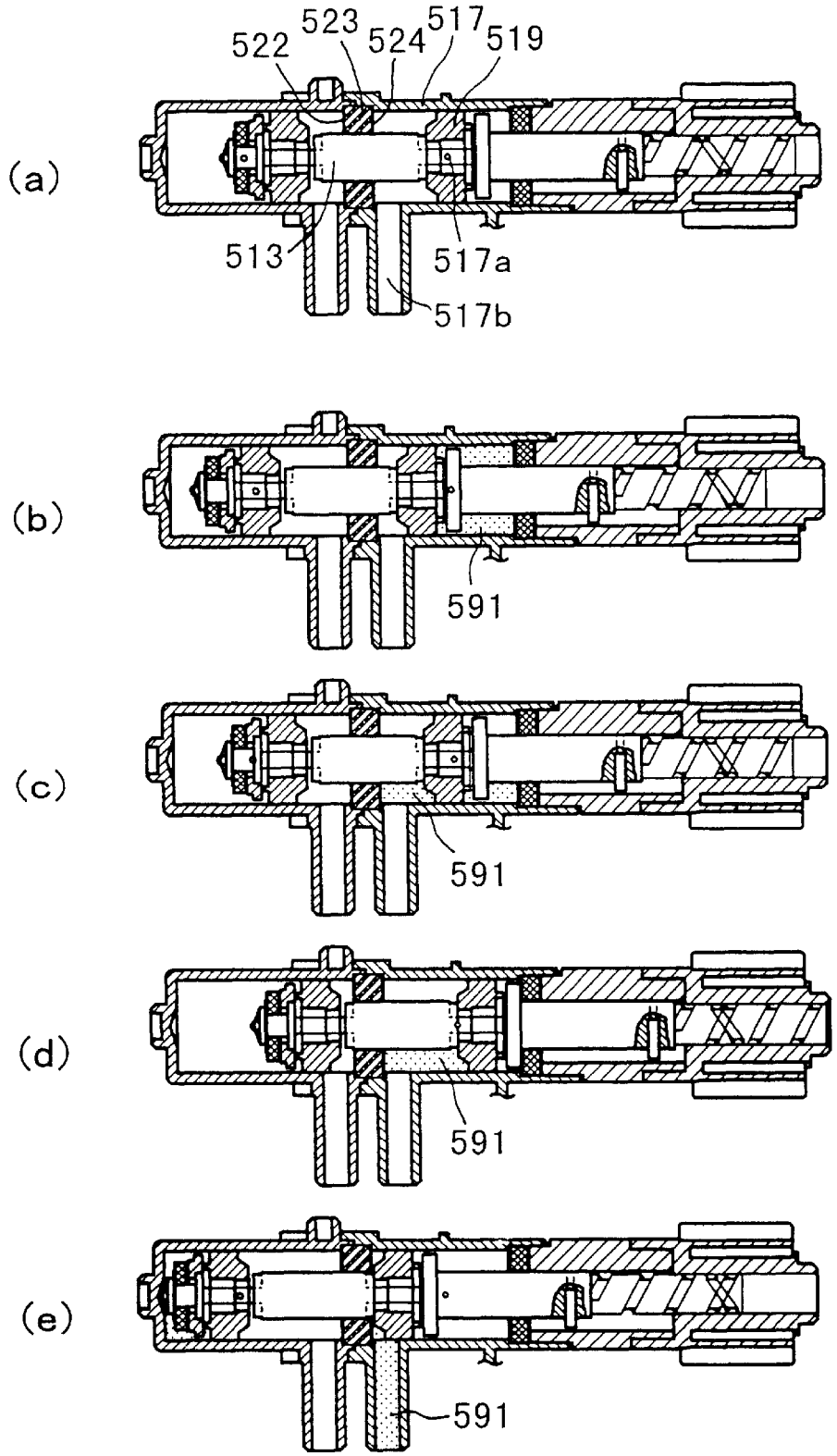
FIG. 8 is a drawing for describing the operational sequence through which ink is suctioned into, or discharged from, the cylinder 517 illustrated in FIG. 6.

FIG. 8 is a drawing for describing the processes through which ink is suctioned into, or discharged from, the cylinder 517 illustrated in FIG. 6.

Since the processes through which ink is suctioned into, or discharge from, the cylinder portion 517 are the same as those for the cylinder portion 516, the detailed description thereof will be omitted.

As shown in FIG. 6, there are a few internal spaces in the cylinder portion 517. One of the longitudinal ends of the piston shaft 513 is in the left most internal space in the cylinder portion 517. With this arrangement, the aforementioned leftmost internal space is greater in volume than the rightmost internal space in the cylinder portion 517. The leftmost and rightmost internal spaces are connected to the relatively large cap 528 (FIG. 3), and the relatively small cap 529 (FIG. 3), respectively. The relatively large cap 528 and relatively small cap 529 are used to cap a color ink head (FIG. 16) which is relatively large in the total number of ejection orifices, and a black ink head (FIG. 16) which is relatively small in the total number of ejection orifices, respectively. In this embodiment, the color ink head comprises 48 ejection orifices for black ink, 48 ejection orifices for cyan ink, 48 ejection orifices for magenta ink, and 48 ejection orifices for yellow ink, totaling 192 ejection orifices. The black ink head has 160 ejection orifices. In other words, a head having the greater number of ejection orifices to be capped is capped with the relatively large cap, which is connected to the cylinder portion larger in the volume of the internal space into which ink is suctioned. This is because it is desired that the greater a printing head is in the total number of ejection orifices to be capped together, the larger the amount of liquid to be suctioned must be, so that ejection orifices are equalized in the amount of the ink suctioned through them. The photographic head is the same as the color ink head in the total number of ejection orifices. In other words, the photographic ink head is provided with 48 ejection orifices for photographic black ink, 48 ejection orifices for photographic cyan ink, 48 ejection orifices for photographic magenta ink, and 48 ejection orifices for photographic yellow ink, totaling 192 ejection orifices. The photographic ink head is capped by the cap 528, that is, the same cap as the one for the color ink head, and is suctioned by the leftmost most portion of the cylinder, which is relatively large in the internal space.

In this embodiment, in order to make the color ink head and photographic ink head greater in the total amount of suction than the black ink head, the pumping means is structured so that the length of the stroke of the piston 518 between the position from which the piston 518 begins to move, and the position of the other end of the stroke, can be adjusted depending on head type. In other words, the length of the stroke of the piston 518 is made greater when the color ink head or photographic ink head is suctioned than when the black ink head is suctioned.

Next, the pistons 518 and 519 illustrated in FIG. 6 will be described in detail.

Figure 9A:
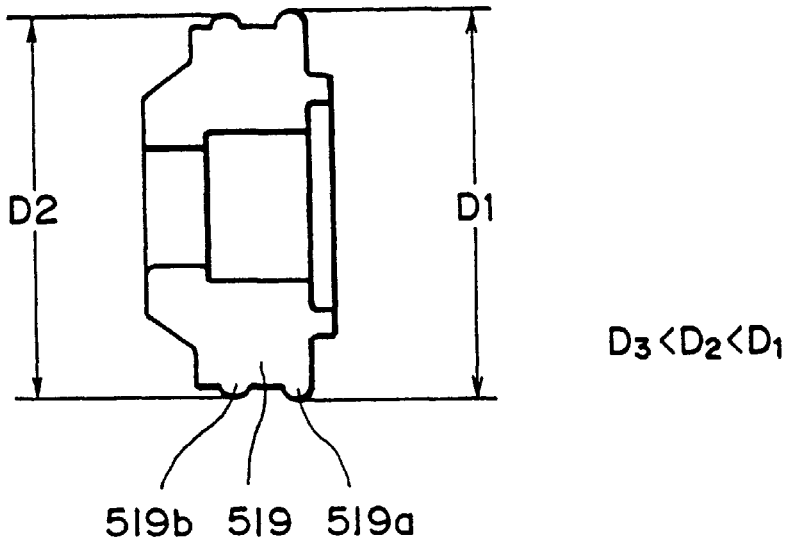
FIG. 9 is a schematic drawing for describing the shape of the piston illustrated in FIG. 6.
Figure 9B:
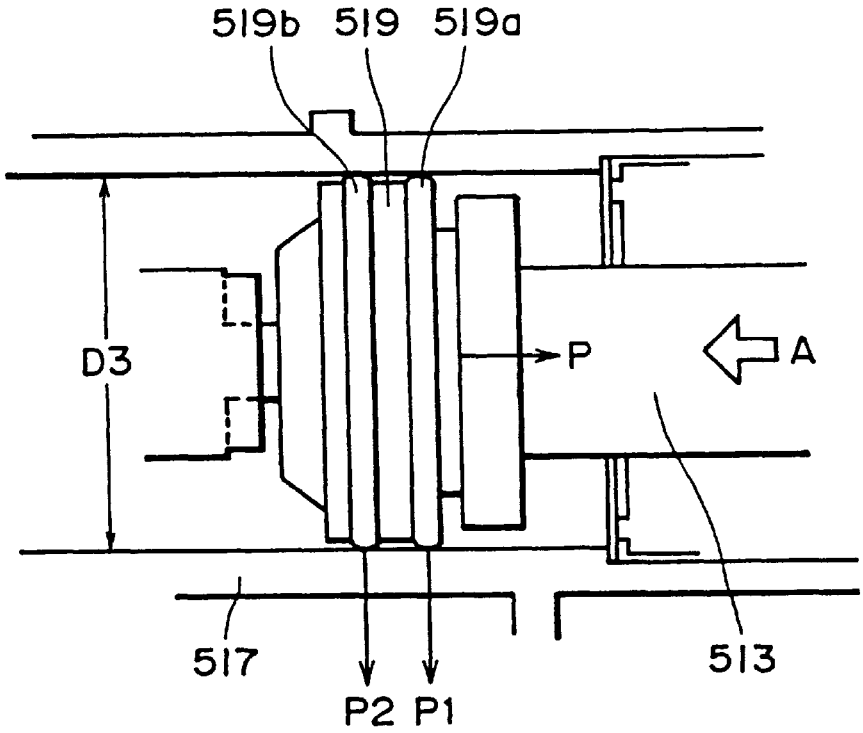

FIG. 9 is a drawing for describing the configurations of the pistons 518 and 519 illustrated in FIG. 6. At this time, the description will be given with reference to the piston 519.

Referring to FIG. 9, the piston 519 is provided with ring portions 519*a* and 519*b*, which are on the peripheral surface of the piston 519, and are the only portions of the piston 519 which make contact with the internal surface of the cylinder portion 517.

With the provision of the above described structure, the size of the contact area between the piston 519 and the internal surface of the cylinder portion 517 is smaller than when the piston 519 is not provided with the rings 519*a* and 519*b*.

Therefore, even if the piston 519 is caused to temporarily stick to the cylinder portion 517 by the ink which has solidified in the gap between the cylinder portion 517 and piston 519 after flowing into the gap, the force required to loosen the piston 519 from the cylinder portion 517 is smaller, making this structural arrangement advantageous in that it is unlikely to make the pumping means 503 impossible to drive.

The relationship among the external diameter D1 of the ring portion 519*a*, the external diameter D2 of the ring portion 519*b*, and the internal diameter D3 of the cylinder portion 517 is: D3<D2<D1. In other words, the ring portion 519*a* with the external diameter of D1, which is on the upstream side in terms of the direction in which the piston 519 is moved to suction ink, is greater in the external diameter than the ring portion 519*b* with the external diameter of D2, which is on the downstream side.

This structural arrangement is made so that the contact pressure P1 between the ring portion 519*a* and cylinder portion 517 remains the same as the contact pressure P2 between the ring portion 519*b* and cylinder portion 517 while the piston shaft 513 moves in the cylinder portion 517 in the direction indicated by an arrow mark A, that is, the ink suctioning direction.

As the piston shaft 513 moves in the direction of the arrow mark A, a reactive force P, the direction of which is opposite to the direction of the arrow mark A, applies to the piston 519 due to the friction between the internal surface of the cylinder portion 517 and the peripheral surface of the piston 519. This sometimes causes the deformation of the piston 519, which makes the contact pressure P1 smaller than the contact pressure P2.

In the above described situation, the piston 519 becomes unstable, threatening to increase the possibility that suction failure or the like will occur due to leakage.

The piston 518 is also provided with ring portions, which are on the peripheral surface of the piston 518. The external diameter D1 of the ring portion located on the upstream side in terms of the direction in which the piston 518 moves to suction ink is greater than the external diameter of the ring portion on the downstream side.

Next, the relationship between the external diameter D1 of the ring portion 519*a* and the contact pressure P1, and the relationship between the external diameter D1 of the ring portion 519*a* and the contact pressure P2, will be described.

Figure 10:
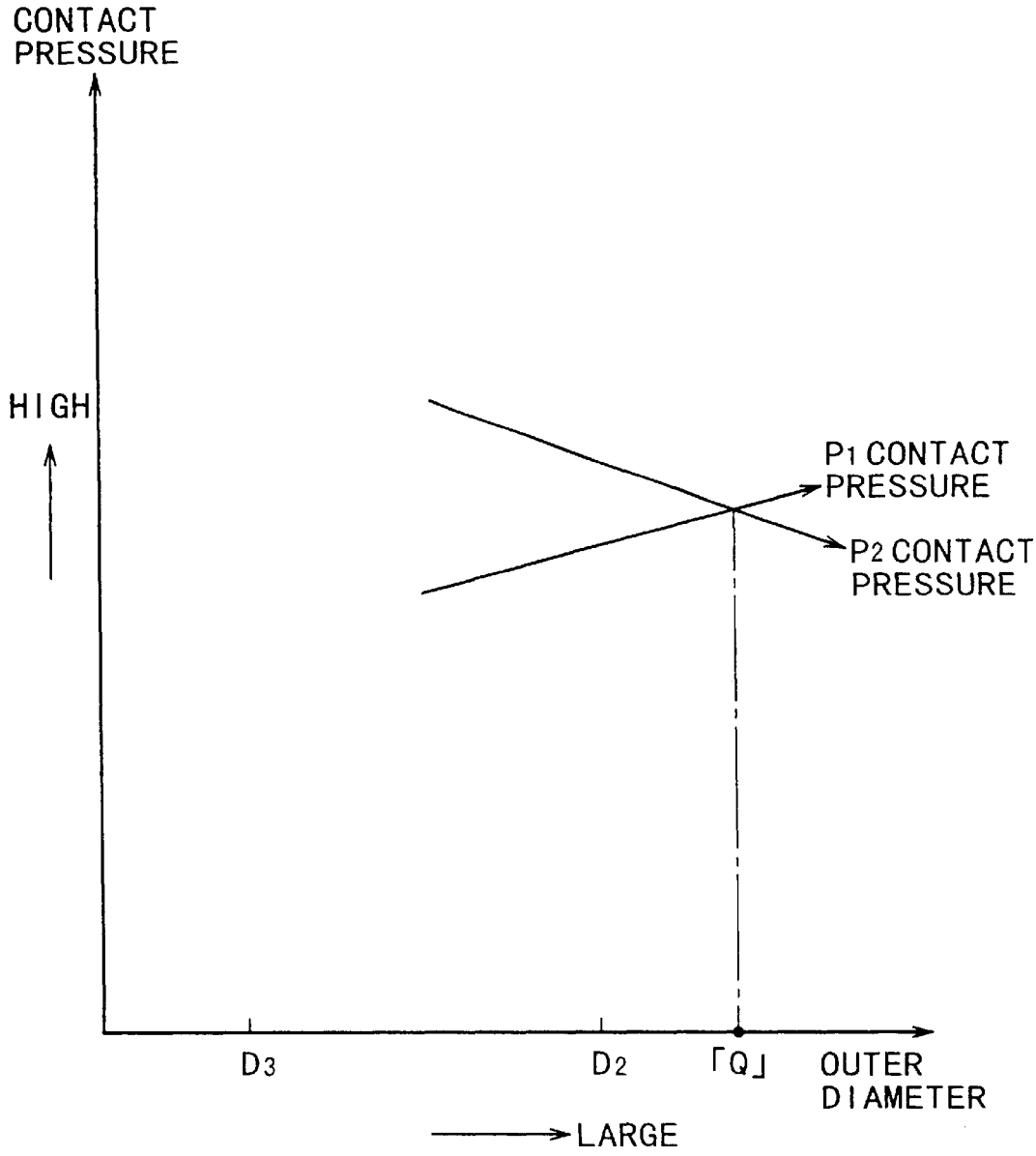
FIG. 10 is a graph for describing the relationship between the external diameter D1 of the ring portion 519*a* illustrated in FIG. 9, and the contact pressure P1 applied by the ring portion 519*a* upon the cylinder 517, and the relationship between the external diameter D1 of the ring portion 519*a* and the contact pressure P2 applied by the ring portion 519*b* upon the cylinder 517.

FIG. 10 is a drawing for describing the relationship between the external diameter D1 of the ring portion 519*a* illustrated in FIG. 9 and the contact pressure P1 of the ring portion 519*a* upon the cylinder 517, and the relationship between the external diameter D1 of the ring portion 519*a* and the contact pressure P2 of the ring portion 519*b* upon the cylinder 517.

FIG. 10 represents a case in which the value of the internal diameter D3 of the cylinder portion 517, and the value of the external diameter D2 of the ring portion 519*b*, were preset so that the external diameter D2 of the ring portion 519*b* became larger than the internal diameter D3 of the cylinder portion 517, and only the external diameter D1 of the ring portion 519*a* was varied.

As shown in FIG. 10, as the external diameter D1 of the ring portion 519*a* was varied from a small size to a larger size, the contact pressure P1 increased, whereas the contact pressure P2 decreased. Eventually, the contact pressures P1 and P2 became equal to each other at a point at which the value of the external diameter D1 was "Q (>external diameter D2)".

In other words, the contact pressures P1 and P2 can be rendered equal to each other by setting the value of the external diameter D1 of the ring portion 519*a* to "Q", so that the piston 519 can be stabilized in its shuttling movement.

Next, the positional relationship between the pumping means 503 and capping means 501 illustrated in FIG. 3 will be described, along with the structure of the capping means 501.

Figure 11:
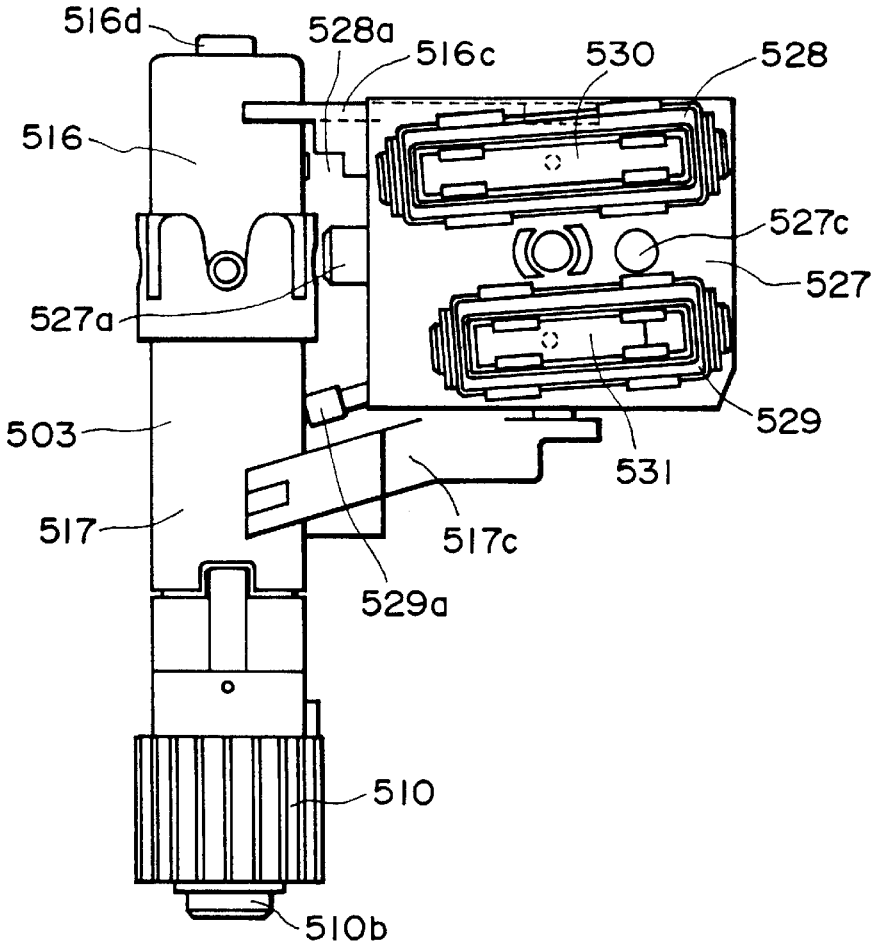
FIG. 11 is a plan view of the adjacencies of the joint between the pumping means and capping means illustrated in FIG. 3.
Figure 12:
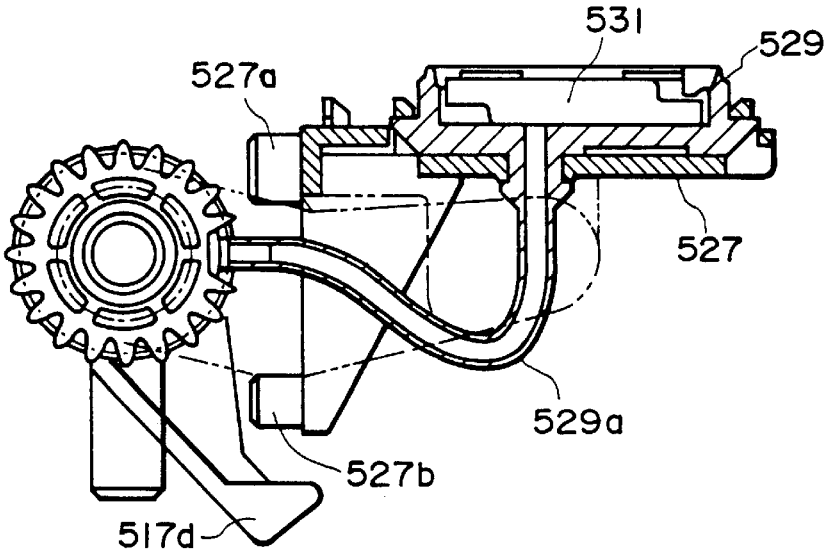
FIG. 12 is a sectional view of the capping means illustrated in FIG. 11.

FIG. 11 is a plan view of the joint between the pumping means and capping means 501 illustrated in FIG. 3, and its adjacencies. FIG. 12 is a sectional view of the cap 529 illustrated in FIG. 11.

The capping means 501 is rotationally supported. More specifically, the caps 528 and 529 are fixed to a cap holder 527 provided with two bosses. The two bosses are fitted one for one in the hole of an arm portion 516*c* integrally formed with the cylinder portion 516 and the hole of the arm portion 517*c* integrally formed with the cylinder portion 517.

The cap holder 527 has two positioning bosses 527*a* and 527*b*, in addition to the aforementioned two bosses. These bosses 527*a* and 527*b* are fitted in a groove (unillustrated) which is U-shaped in cross section and with which the base 601 (FIG. 4) is provided.

Further, the cap holder 527 is provided with a hole 527*c* as a positioning hole in which the boss portion (unillustrated) of the base 601 is fitted.

The cap 528 is provided with a tube portion 528*a*, which is integrally formed with the cap 528. This tube portion 528*a* is connected to the ink suctioning portion, in the form of a projection, with which the cylinder portion 516 is provided; the tube portion 528*a* is press-fitted around the projection.

The cap 528 has an internal absorbent member 530 for absorbing and retaining the ink within the cap 528.

The cap 529 has a tube portion 529*a*, which is integrally formed with the cap 529. This tube portion 529*a* is connected to the ink suctioning portion, in the form of a projection, with which the cylinder portion 517 is provided; the tube portion 529*a* is press-fitted around the projection.

Further, the cap 529 has an internal absorbent member 531 for absorbing and retaining the ink within the cap 529.

The pumping means 503 is rotationally supported by the base 601. More specifically, the shaft portion 510*b* of the piston gear 510 is fitted in the hole of the base 601, and the shaft portion 516*d* of the cylinder portion 516 is fitted in the hole of a bearing 532 (FIG. 4) with which the base 601 is provided.

The pumping means 503 is under the pressure applied from the back side of the cap holder 527, in the direction to rotate the pumping means 503, by the spring 544 (FIG. 5) with which the base 601 is provided.

An arm portion 517*d* is an integrally formed portion of the cylinder portion 517, and regulates the rotation of the pumping means 503, in coordination with the cam portion 604*c* (FIG. 4) of the P output gear 604 (FIG. 4).

While the pumping means 503 suctions ink, the cap 528 or 529 is kept in contact with the printing head mounted on the carriage 201 (FIG. 1). The amount of the pressure with which the cap 528 or 529 is pressed upon the printing head is set at a predetermined value.

Also during this period, the arm portion 517*d* remains separated from the cam portion 604*c* of the P output gear 604.

Next, the wiping means 502 illustrated in FIG. 3 will be described in detail.

Figure 13:
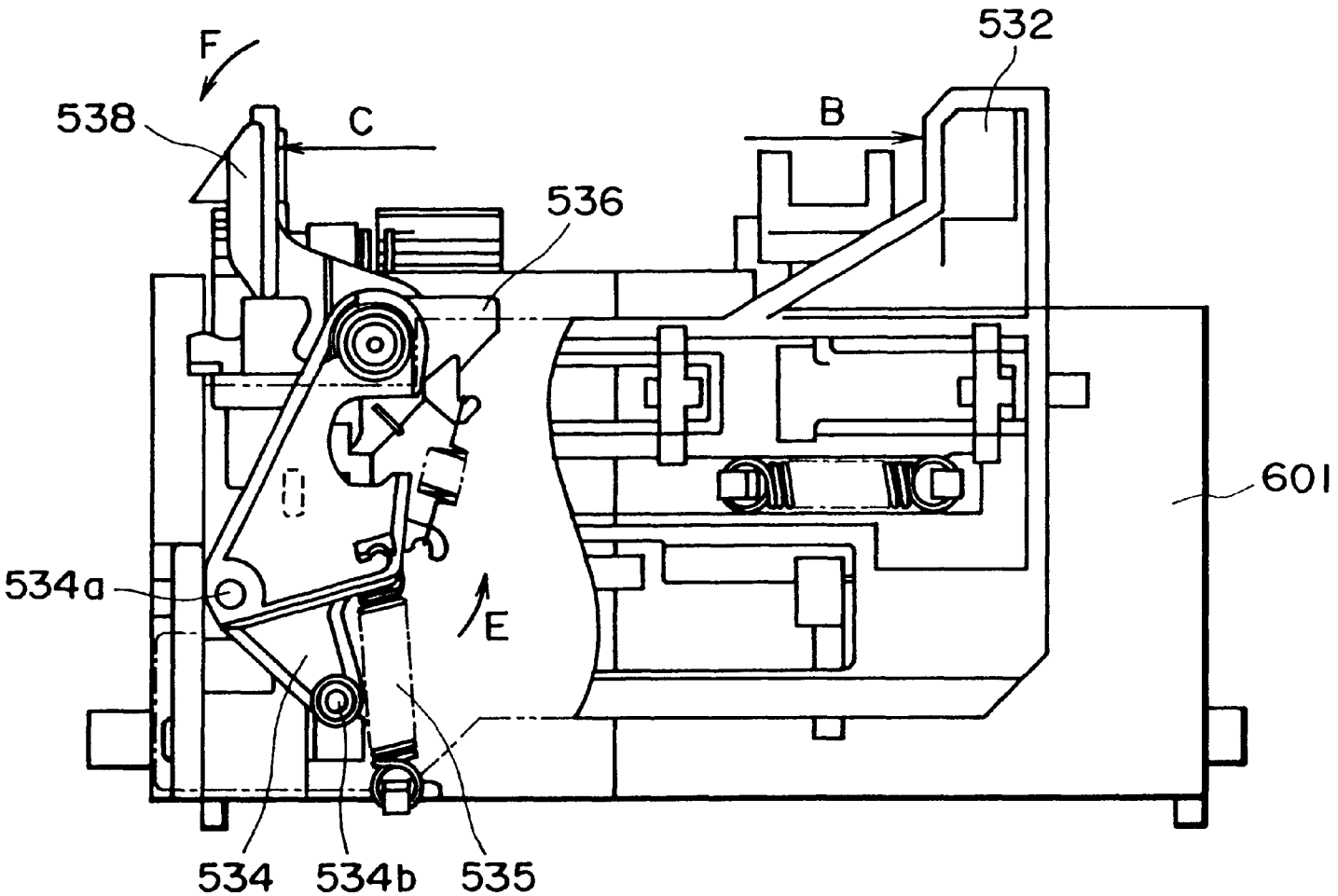
FIG. 13 is a plan view of the front side of the driving mode switching means illustrated in FIG. 3.
Figure 14:
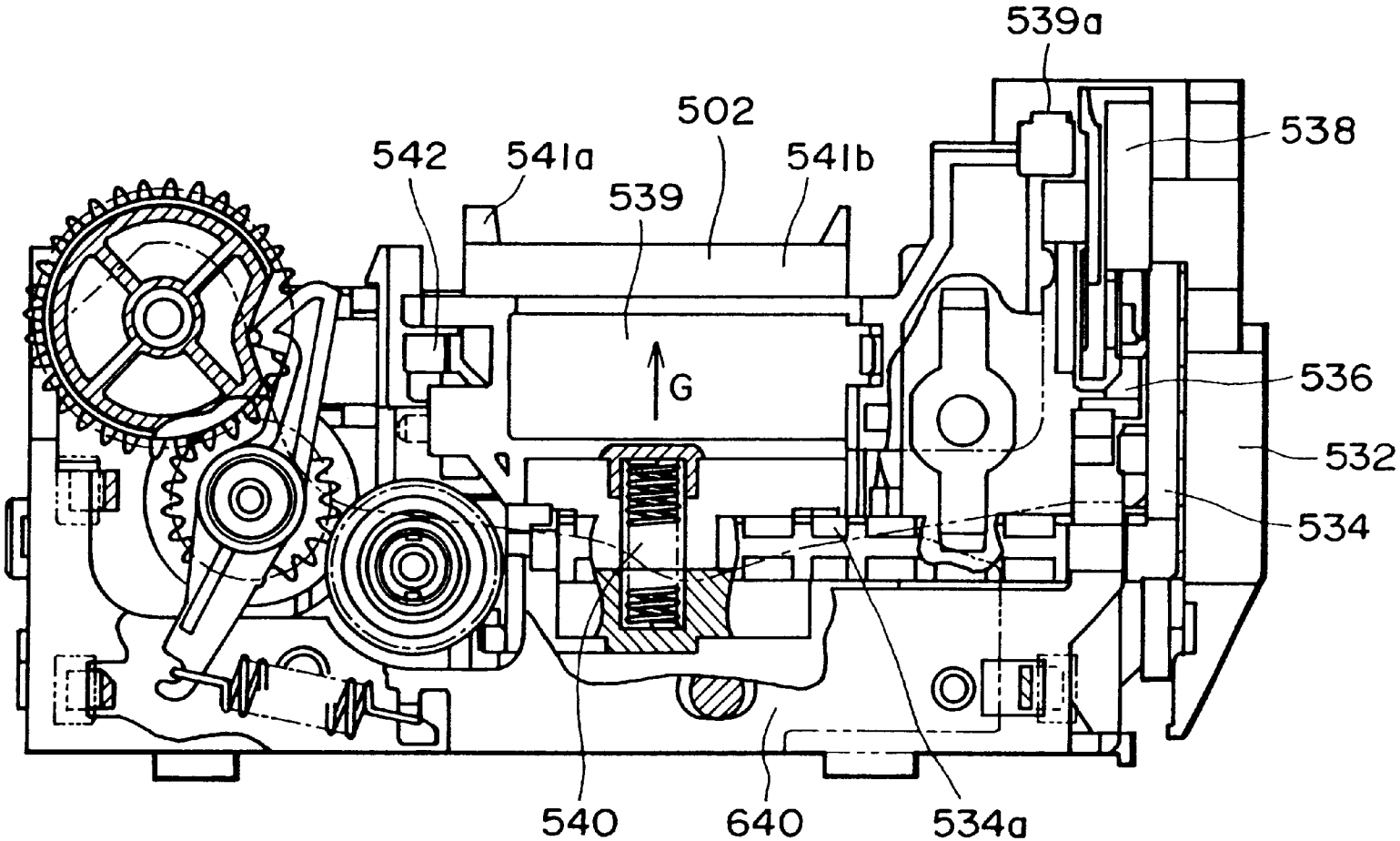
FIG. 14 is a plan view of the left side of the driving mode switching means illustrated in FIG. 3.

FIG. 13 is a plan view of the front side of the driving mode switching means 600 illustrated in FIG. 3. FIG. 14 is a plan view of the left side of the driving mode switching means 600 illustrated in FIG. 3.

FIG. 13 shows the state of the driving mode switching means 600, in which the wiping means 502, disposed within the driving mode switching means 600, is at the wiping position for wiping the printing head mounted on the carriage 201 (FIG. 1).

First, referring to FIGS. 13 and 14, the steps for setting the wiping means 502 in the driving mode switching means 600, at the wiping position, and the steps for disengaging the wiping means 502, will be described.

As a B trigger lever 532 is moved in the direction of an arrow mark B by the movement of the carriage 201, the cam portion (unillustrated) of the B trigger lever 532 engages with the boss portion 534*b* of a B lever 534, causing the B lever 534 to move in the direction of an arrow mark E.

The B lever 534 is between the base 601 and a base cover 640, being sandwiched between them.

A B lock 536 is rotationally supported by the B lever 534. As the B lever 534 rotates at a predetermined angle, the B lock 536 slides onto the projecting portion of the base 601, becoming locked in order to complete the steps for setting the wiping means 502 for wiping.

The B lock release lever 538 is a lever for dissolving the locked state of the B lock 536. As the carriage 201 moves in the direction of an arrow mark C after the completion of the wiping operation, the carriage 201 comes into contact with the B lock release lever 538, causing the B lock release lever 538 to move in the direction of an arrow mark F. As a result, the B lock 536 rotates in the lock releasing direction, allowing the B lever 534 to be set at the no-wiping position by a pressure generating means 535 such as a spring placed between the base 601 and B lever 534, dissolving the state in which the wiping means 502 is ready for wiping.

Next, the structure of the wiping means 502 will be described.

Referring to FIGS. 13 and 14, the wiping means 502 has blades 541*a* and 541*b* for removing the ink adhering to the printing head surface with the ejection orifices, a B holder 539 which supports the blades 541*a* and 541*b* through a spacer (unillustrated), and supports a B retainer 542 for retaining the B holder 539. The B holder 539 is under pressure generated in the direction of an arrow mark G by a pressure generating means 540 such a spring placed between the B holder 539 and the B lever 534.

In the wiping operation of the wiping means 502 structured as described above, the striking surface 539*a* of the B holder 539 comes in contact with the bottom surface of the carriage 201 to control the amount of the overlap between the surface (with the ejection orifices) of the printing head mounted on the carriage 201, and the blades 541*a* and 541*b*, so that the surface (with the ejection orifices) of the printing head is properly wiped by the blades 541*a* and 541*b*.

Figure 15:
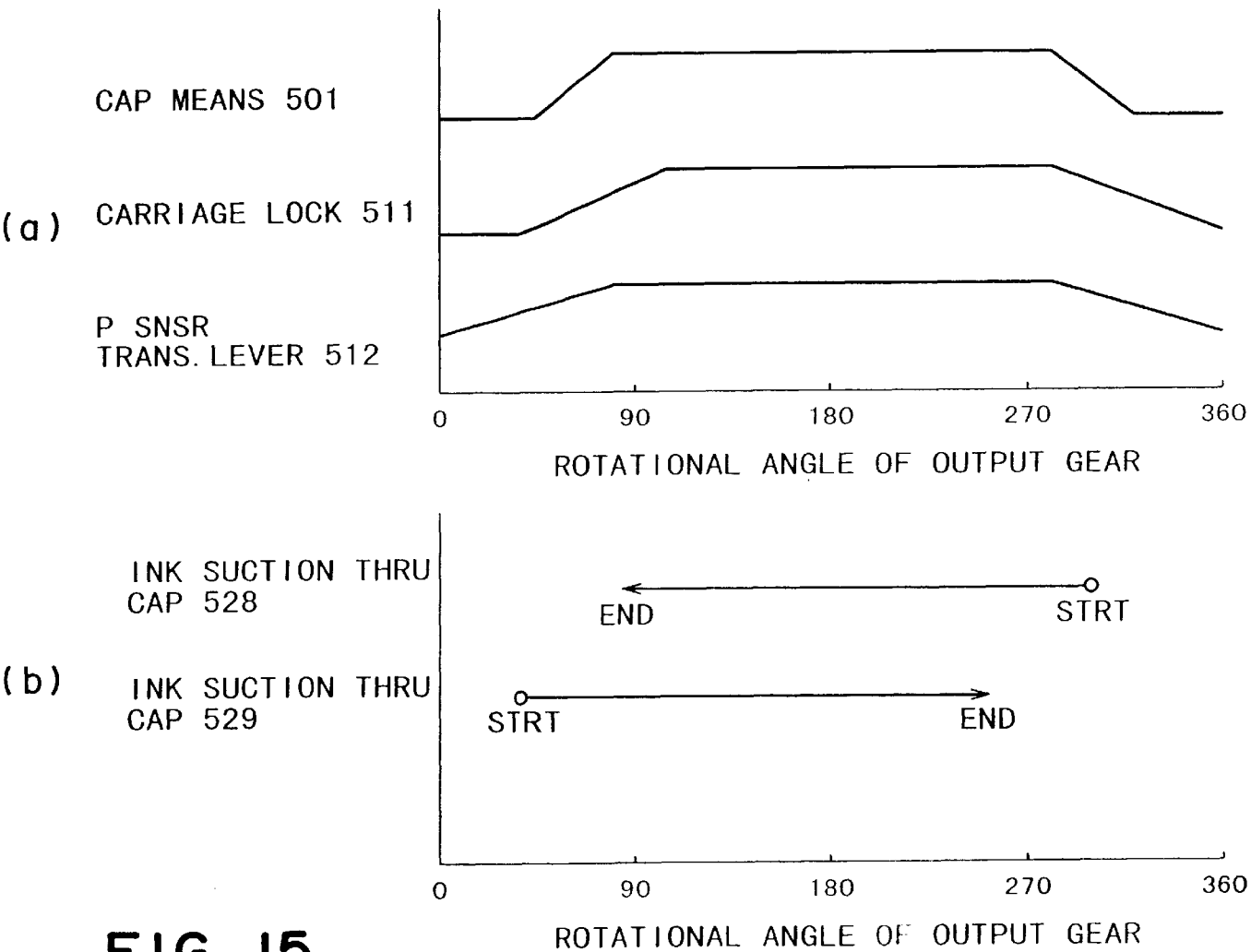
FIGS. 15, (*a*) and (*b*), are graphs for describing the movements of the capping means, carriage lock, and P sensor transmission lever, with respect to the rotational angle of the P output gear illustrated in FIG. 3, and the movement of the ink suctioning movement of the pumping means with respect to the rotational angle of the P output gear, respectively.

FIG. 15 is a graph for describing the movements of the various components disposed within the driving mode switching means, with respect to the rotational angle of the P output gear 604 illustrated in FIG. 3; Figure (a) depicts the movements of the capping means 501, a carriage lock 511 (FIG. 4), and the P sensor transmission lever 512 (FIG. 3), and Figure (b) depicts the ink suctioning movement of the pumping means 503.

The P output gear 604 can be rotated either forward or in reverse within a range of 0°–330°. The rotational angle of 0° corresponds to the home position, which is used as the referential position for the capping operation of the capping means 501, for the ink suctioning operation of the pumping means 503, and for the like operations.

For example, when ink is suctioned by the pumping means 503 through the cap 528, the P output gear 604 rotates in reverse from the position corresponding to a rotational angle of 299° to the position corresponding to a rotational angle of 82°, whereas when ink is suctioned through the cap 529, the P output gear 604 rotates forward from the position corresponding to a rotational angle of 35° to a position corresponding to a rotational angle of 250°.

In terms of the rotational angle, the position from which the P output gear 604 begins to rotate, and the position at which it stops rotating, correspond to the amount of ink to be suctioned into the cylinder portions during the ink sucking strokes of the pistons and during the dry strokes of the pistons, and also correspond to the amount of the negative pressure which applies to the printing head while ink is suctioned. The pumping means 503 is provided with a plurality of operational modes inclusive of the number of pumping strokes to be repeated for ink suction and virtually dry suction, so that an optimal operation mode is selected from among the plurality of operation modes according to the aforementioned factors.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

cap members for capping ejection outlets of an ejection portion for ejecting liquid to a recording material;

pump means which includes cylinder means including a plurality of cylinders having suction inlets in fluid communication within said cap members and discharging outlets for discharging the liquid, respectively, a seal member for dividing inner space in the cylinder means into said plurality of cylinders, and a plurality of pistons reciprocable in inner spaces in contact with inner surfaces of the cylinders to produce pressure change in the inner spaces, wherein in each of said plurality of cylinders, said suction inlet is disposed more away from said seal member than said discharging outlet.

2. An apparatus according to claim 1, wherein volumes of the inner spaces of the cylinders are different from each other.

3. An apparatus according to claim 2, wherein the volumes of the inner spaces of the cylinders are different depending on a type of said ejection portion.

4. An apparatus according to claim 1, wherein said pump means has a piston shaft for commonly supporting said pistons, and the pistons are moved by reciprocation of the common piston shaft in the inner spaces in the cylinders.

5. An apparatus according to claim 1, wherein said pump means includes a common piston shaft which has an end in one of said inner spaces.

6. An apparatus according to claim 5, wherein one of said inner spaces of the cylinders is larger than the other.

7. An apparatus according to claim 1, wherein each of said pistons has a plurality of ring members, and wherein only outer peripheral surfaces of said ring members are contacted to the inner surfaces of the cylinders, respectively.

8. An apparatus according to claim 7, wherein said ring members have different outer diameters.

9. An apparatus according to claim 8, wherein the outer diameter of such one of the ring members as is disposed upstream with respect to a moving direction of said piston in a sucking operation is larger than the outer diameter of the ring member disposed downstream.

10. An apparatus according to claim 9, wherein said ring members are contacted to the respective cylinders with substantially the same contact pressure.

11. An apparatus according to claim 1, wherein starting positions and ending positions of said pistons in a sucking operation are different depending on the type of said ejection portion.

12. An apparatus according to claim 1, further comprising an electrothermal transducer for generating thermal energy contributable to ejection of the liquid through said ejection outlet.

13. A pump for an image forming apparatus which includes cap members for capping ejection outlets of an ejection portion for ejecting liquid to a recording material, said pump comprising:

cylinder means including a plurality of cylinders having suction inlets in fluid communication with said cap members and discharging outlets for discharging the liquid, respectively, a seal member for dividing inner space in the cylinder means into said plurality of cylinders, and a plurality of pistons reciprocable in spaces in contact with inner surfaces of the cylinders to produce pressure change in the inner spaces, wherein in each of said cylinders, said suction inlet is disposed more away from said seal member than said discharging outlet.

* * * * *

UNITED STATES PATENT AND TRADEMARK OFFICE

CERTIFICATE OF CORRECTION

PATENT NO. : 6,629,748 B2
DATED : October 7, 2003
INVENTOR(S) : Shimoyama

It is certified that error appears in the above-identified patent and that said Letters Patent is hereby corrected as shown below:

Title page,
Item [75], Inventor, "Kanagawa-ken" should read -- Yokohama --; and

Column 2,
Lines 26 and 41, "portions" should read -- portion --.

Column 3,
Line 8, "member," should read -- members, --.

Column 8,
Line 27, "discharge from" should read -- discharged from --.

Signed and Sealed this

Seventeenth Day of August, 2004

JON W. DUDAS
*Acting Director of the United States Patent and Trademark Office*